US006533039B2

(12) United States Patent
Rivas et al.

(10) Patent No.: US 6,533,039 B2
(45) Date of Patent: Mar. 18, 2003

(54) WELL COMPLETION METHOD AND APPARATUS WITH CABLE INSIDE A TUBING AND GAS VENTING THROUGH THE TUBING

(75) Inventors: Olegario S. Rivas, Bartlesville, OK (US); John C. Pursell, Bartlesville, OK (US)

(73) Assignee: Schlumberger Technology Corp., Sugar Land, TX (US)

( * ) Notice: Subject to any disclaimer, the term of this patent is extended or adjusted under 35 U.S.C. 154(b) by 58 days.

(21) Appl. No.: 09/784,686

(22) Filed: Feb. 15, 2001

(65) Prior Publication Data

US 2002/0121376 A1 Sep. 5, 2002

(51) Int. Cl.[7] ..... E21B 43/12; E21B 43/34

(52) U.S. Cl. ..... 166/369; 166/265; 166/105.5; 166/242.3

(58) Field of Search ..... 166/369, 265, 166/105.5, 242.2, 242.3, 242.6, 189, 66.4, 312

(56) References Cited

U.S. PATENT DOCUMENTS 4,502,536 A * 3/1985 Setterberg, Jr. ..... 166/105.5
4,624,310 A * 11/1986 Echols et al. ..... 166/105.5
5,478,970 A * 12/1995 Lawler et al. ..... 174/74 R
5,954,136 A * 9/1999 McHugh et al. ..... 166/384
6,017,198 A * 1/2000 Traylor et al. ..... 166/105
6,135,210 A 10/2000 Rivas
6,138,758 A * 10/2000 Shaw et al. ..... 166/105.5
6,145,597 A * 11/2000 Kobylinski ..... 166/369
6,260,626 B1 * 7/2001 Rivas ..... 166/105.5
6,341,652 B1 * 1/2002 Malone et al. ..... 166/133

* cited by examiner

*Primary Examiner*—David Bagnell
*Assistant Examiner*—Shane Bomar
(74) *Attorney, Agent, or Firm*—Fletcher, Yoder & Van Someren; Jeffrey E. Griffin; Brigitte Jeffery

(57) ABSTRACT

A packer is disposed within a wellbore casing. The packer defines a first and a second zone of the wellbore. A submersible pumping system is used to displace liquid from the first zone of the wellbore via a first fluid flow path. A cable is used for supplying power to the submersible pumping system. The cable extends through tubing that extends from a surface location. A second fluid flow path extends from the first zone of the wellbore to a surface location. A portion of the second fluid flow path extends through the tubing.

32 Claims, 2 Drawing Sheets

WELL COMPLETION METHOD AND APPARATUS WITH CABLE INSIDE A TUBING AND GAS VENTING THROUGH THE TUBING

FIELD OF THE INVENTION

The present invention relates to the field of well completions for producing fluids, such as petroleum and gas, from wells. More particularly, the invention relates to a technique for transporting fluids through the interior of a tubing housing a power cable for a submersible pumping system.

BACKGROUND OF THE INVENTION

A variety of pumping systems have been devised and are currently in use for raising fluids from wells, such as petroleum production wells. In general, where a subterranean formation provides sufficient pressure to raise wellbore fluids to the earth's surface, the well may be exploited directly by properly channeling the fluids through conduits and above-ground valving. However, when the subterranean formations do not provide sufficient pressure, submersible pumping systems are commonly employed force wellbore fluids to the earth's surface for subsequent collection and processing. A packer or other fluid barrier may be placed above the pumping system to fluidicly isolate the portion of the wellbore to be pumped.

In general, one class of submersible pumping systems includes a prime mover, typically an electric motor, coupled to a pump. The electric motor and pump are positioned within wellbore fluids and the pump is driven by the electric motor to draw the fluids into the pump and to force them, under pressure, to the earth's surface. A power cable is routed from the surface through the packer to the electric motor.

The fluids produced by the pump may be forced upwardly through the packer and various types of conduit, such as the well casing, or production tubing, to a collection point at the earth's surface. The pumping systems may also include ancillary components, depending upon the configurations of the subterranean formations. Such components often include separators for removing oil from water or gas, and injection pumps or compressors for re-injecting water or other non-production fluids into designated subterranean formations above or below the producing horizons.

Gas from the formation or from the gas separator can collect, or be collected, under the packer. The gas may cause the submersible pumping system to fail if the volume of the gas is allowed to grow until it encompasses the fluid intake of the submersible pumping system. Therefore, a technique for venting gas through the packer to prevent the volume of gas from reaching the submersible pumping system fluid intake is desirable.

Also, it is sometimes desirable to inject chemicals or fluids into the vicinity of a subterranean formation. Such fluids may include anticorrosive agents, viscosity reducing agents, scale inhibitors, and so forth. However, unless dedicated chemical injection lines are provided in the pumping system during its deployment, such injection is often difficult or impossible to accommodate without removal of the pumping system from the well. Therefore, a technique for injecting chemicals through the packer also is desirable.

However, space constraints can limit the number of passageways that can be placed through the packer. Also, a greater number of passageways through the packer increases the difficulty of maintaining a fluid seal with the packer.

SUMMARY OF THE INVENTION

The present invention features a system for producing fluid from a wellbore. The system comprises a packer disposed within a wellbore casing. The packer defines a first and a second zone of the wellbore. The system also comprises a submersible pumping system to displace liquid from the first zone of the wellbore to a desired location via a first fluid flow path. The system also comprises tubing and a power cable disposed within the tubing to supply power to the submersible pumping system. A second fluid flow path also extends from the first zone of the wellbore. At least a portion of the second fluid flow path is disposed within the tubing.

According to another aspect of the invention, a well completion system for raising fluids from a well is featured. The well completion system comprises a packer for dividing the well into an upper zone and a lower zone. The packer has first and second passageways that extend through the packer between the upper zone and the lower zone. A pumping system is disposed in the lower zone and is operable to displace fluids from the lower zone through the first passageway via a first fluid path. A power cable for supplying power to the pumping system extends through a fluid conduit. The fluid conduit also serves as part of a second fluid path extending through the second passageway in the packer.

According to another aspect of the invention, a method for producing fluid from a wellbore is featured. The method comprises the act of deploying a completion system in the wellbore. The completion system comprises a packer, having first and second passageways therethrough and a pumping system disposed in a lower zone below the packer. The pumping system discharges fluid into the first passageway. Furthermore, the well completion system comprises a conduit having a power cable disposed therein. Fluid is directed through the conduit which is in fluid communication with the lower zone via the second passageway.

The above description of various aspects of the present invention is merely exemplary and is not intended to limit the scope of the invention.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figures 1, 2:
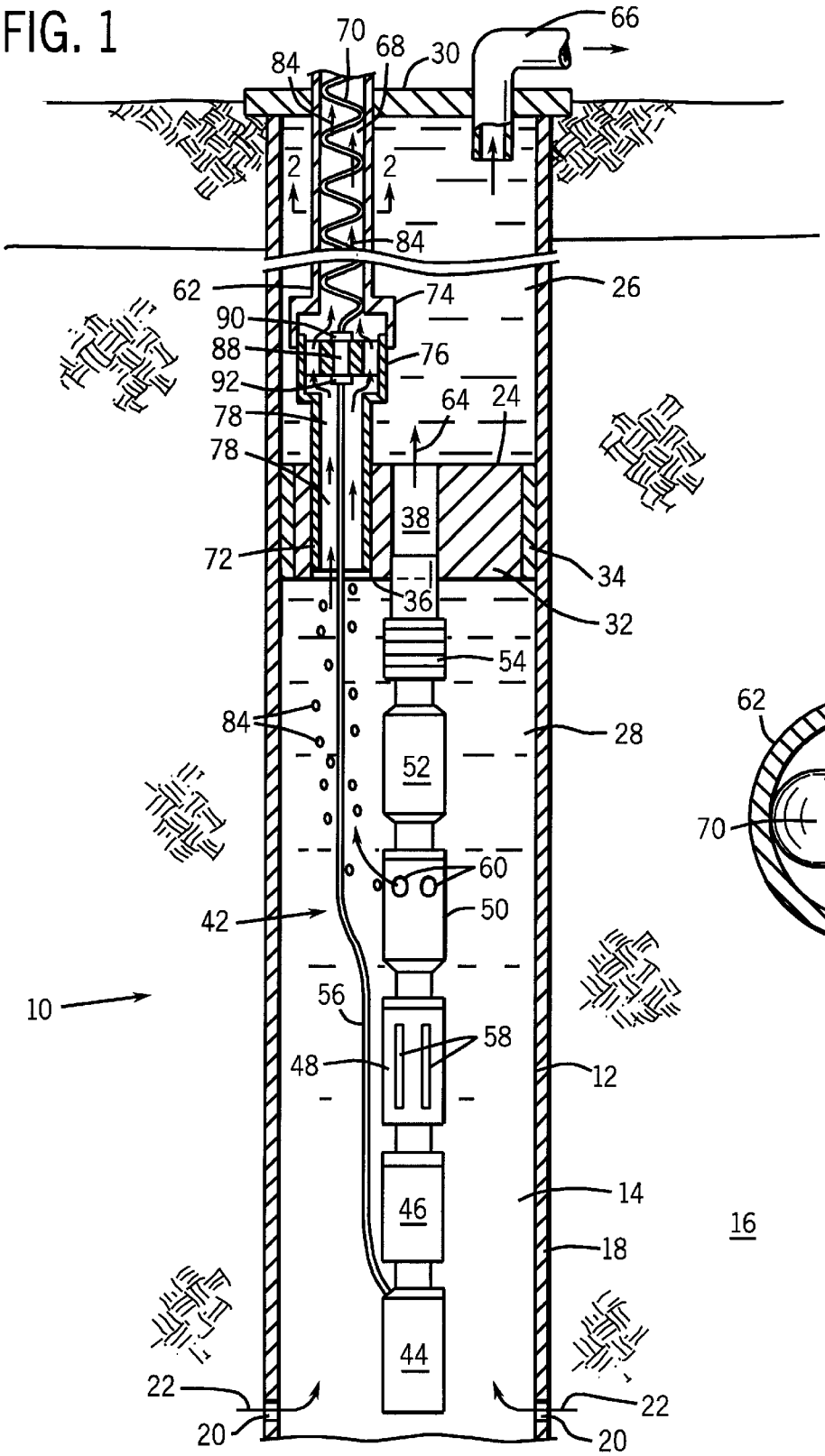
FIG. 1 is a front elevational view of a well completion system positioned in a wellbore to vent gas through a conduit having a power cable disposed therein.
FIG. 2 is a cross-sectional view taken generally along line 2—2 of FIG. 1.

Referring generally to FIG. 1, a completion system 10 is illustrated. Completion system 10 is shown deployed in a well 12 which consists of a wellbore 14 traversing one or more subterranean zones or horizons, including a production formation 16. In general, production formation 16 includes geological formations bearing fluids of interest, such as crude oil, gas, paraffin, and so forth. Wellbore 14 is defined by an annular casing 18 through which perforations 20 are formed adjacent to production formation 16. Fluids of interest flow from production formation 16 into casing 18 through perforations 20, as indicated by arrows 22.

It should be noted that while in the illustrated embodiment, and throughout the present description, reference is made to a wellbore which may be generally vertically oriented, the present technique is not intended to be limited to this or any particular well configuration. Thus, where appropriate, the technique may be adapted to directional wells, including inclined or horizontal segments. Moreover, the present technique may be adapted by those skilled in the art to wells including one or more production formations 16, as well as injection zones, gas-producing horizons, and so forth.

In the illustrated embodiment of FIG. 1, completion system 10 includes a fluid barrier 24, such as a packer, secured within casing 18 to divide wellbore 14 into an upper zone 26 and a lower zone 28. Fluid barrier 24 is positioned above production perforations 20 to collect wellbore fluids in lower zone 28. Fluids produced by completion system 10, as described more fully below, are passed through upper zone 26 to wellhead 30 located at the earth's surface. In wells located below a body of water, such as in offshore fields, wellhead 30 may be situated at the sea floor.

Fluid barrier 24 includes a plurality of passageways for receiving and accommodating both production fluids and equipment control lines and cables. As shown in FIG. 1, fluid barrier 24 includes a central portion 32 through which the passageways are formed, and a sealing portion 34 surrounding central portion 32 for exerting a sealing force against the inner periphery of casing 18. As will be appreciated by those skilled in the art, fluid barrier 24 may be configured to be secured within casing 18 in various manners, such as via hydraulic inflation, mechanical actuation, and so forth. Fluid barrier 24 comprises a pair of fluid passageways, a passageway 36 and another passageway 38. The passageways extend through fluid barrier 24 between upper zone 26 and lower zone 28.

In the illustrated embodiment, completion system 10 also includes a pumping system, designated generally by the reference numeral 42, disposed below fluid barrier 24 in lower zone 28. While any suitable type of pumping system may be employed for displacement of production fluids from lower zone 28, in the illustrated embodiment, pumping system 42 is a submersible electrical pumping system or ESP. Thus, in the illustrated embodiment, the pumping system 42 includes a drive motor 44, a motor protector 46, an inlet section 48, a gas/oil separator 50, a pump 52, and an outlet section 54.

Motor 44 is preferably a polyphase electric motor to which power is supplied via a power cable 56. Interior regions of motor 44 may be flooded with a lubricating and cooling medium, such as high quality mineral oil. Power cable 56 supplies electrical power to motor 44. Protector 46 serves to isolate interior regions of motor 44 from wellbore fluids within lower zone 28, and may include labyrinth seals, fluid collection compartments and other isolation structures of a type generally known in the art.

Inlet section 48 is positioned above motor protector 46 and includes inlet apertures 58 for drawing wellbore fluids from lower zone 28 into separator 50. Separator 50 draws such wellbore fluids from inlet section 48 and separates liquid components of the wellbore fluids and gaseous components from one another, expelling the gaseous components through an outlet, illustrated as apertures 60 in FIG. 1. Separator 50 may be any of various known separator types, such as a centrifugal or hydrocyclone separator, or a multi-stage structure including both dynamic and static separating elements. Liquids produced by separator 50 are fed into production pump 52. Pump 52 may include any suitable type of pump, such as a multi-stage centrifugal pump. In the present embodiment, pump 52 is driven by motor 44 via a series of drive shafts (not shown) traversing motor protector 46, inlet section 48 and separator 50. Pump 52 expresses wellbore fluids through outlet section 54.

In the embodiment illustrated in FIG. 1, separator 50 is shown as expressing free gas which collects in an upper region of lower zone 28 and exits via conduit 62. Conduit 62 may comprise any suitable type of production tubing, such as coiled tubing deployed by unrolling from a storage reel during installation of system 10. Conduit 62 permits gas to be directed to a location above the surface of the earth, where its pressure and flow are controlled via conventional valving (not shown). However, gas also may be directed to another subterranean location.

Liquid components of wellbore fluids displaced by pump 52 are expressed through passageway 38 in fluid barrier 24 as indicated by arrow 64 in FIG. 1. The wellbore fluids then collect within upper zone 26 in a generally annular region surrounding conduit 62, and are thereby conveyed to wellhead 30. In the illustrated embodiment, conduit 66, or other fluid conveying structures, is provided at wellhead 30 for directing liquids displaced by pump 52 to a desired collection point for further processing. However, liquids also may be directed to another subterranean location.

In an exemplary configuration, conduit 62 is substantially smaller than the internal diameter of casing 18, thereby defining a generally annular region within casing 18 through which production fluids may flow from pump 52. Because of this enhanced cross sectional area surrounding conduit 62, system 10 thereby permits production of relatively high volumes of liquid components of the wellbore fluids as compared to conventional systems wherein such fluids are conveyed through production tubing. Where desired, liners may be provided within casing 18, or a separate conduit may be secured in fluid communication with passageway 38 of fluid barrier 24 to convey the liquid components of the wellbore fluids. However, the illustrated configuration permits high volume flow rates of production fluids both in gaseous and liquid phase.

Conduit 62 has a hollow interior 68 that is used to route both fluid and a surface power cable 70. In the illustrated embodiment, a flow-through connector 72 is used to couple conduit 62 to fluid barrier 24 and surface power cable 70 to power cable 56. Conduit 62 has a lower connector 74 configured for sealing engagement with an upper connector 76 on flow-through connector 72. Flow-through connector 72 has an interior passageway 78 that fluidicly couples passageway 36 to hollow interior 68 of conduit 62. Conduit 62 and power cable 70 are configured such that the diameter of surface power cable 70 is less than the diameter of the hollow interior 68 of conduit 62, providing a gap 80 for fluid to pass through conduit 62, as best illustrated in FIG. 2.

In the illustrated embodiment, surface power cable 70 is routed through conduit 62 with a degree of slack in cable 70. As best illustrated in FIG. 2, this results in surface power cable 70 contacting the interior surface 82 of conduit 62. The frictional force produced between surface power cable 70 and the interior surface 82 of conduit 62 supports the weight of surface power cable 70.

Fluid may be muted through conduit 62 from the surface to lower zone 28 or from lower zone 28 to the surface. In the illustrated embodiment of FIG. 1, gas 84 is vented through conduit 62. In the illustrated embodiment, gas 84 rises from lower zone 28 through passageway 36 in fluid barrier 24, interior passage 78 of flow-through connector 72, hollow interior 68 of conduit 62, to the surface. Additionally, flow-through connector 72 electrically couples surface power cable 70 to power cable 56. In this embodiment, a cable connector 88 is used to couple surface power cable 70 to power cable 56. Cable connector 88 also anchors surface power cable 70 to flow-through connector 72.

Cable connector 88 may be configured in a variety of different configurations. In the illustrated embodiment, surface power cable 70 is configured with a first electrical connector 90 and pumping system power cable 56 is configured with a second electrical connector 92. First electrical connector 90 and second electrical connector 92 are electrically coupled via cable connector 88. Cable connector 88 may have corresponding third and fourth electrical connectors that are electrically coupled together and configured for mating engagement with the first and second electrical connectors. Alternatively, a single power cable may be used instead of separate power cables. In such an embodiment, cable connector 88 may act as a means to secure the single power cable to flow-through connector 72.

In an alternative embodiment, conduit 62 may be secured directly to fluid barrier 24. A cable connector may be used in this alternative embodiment or a surface power cable may be wired directly through fluid barrier 24 to submersible pumping system 42.

Figure 3:
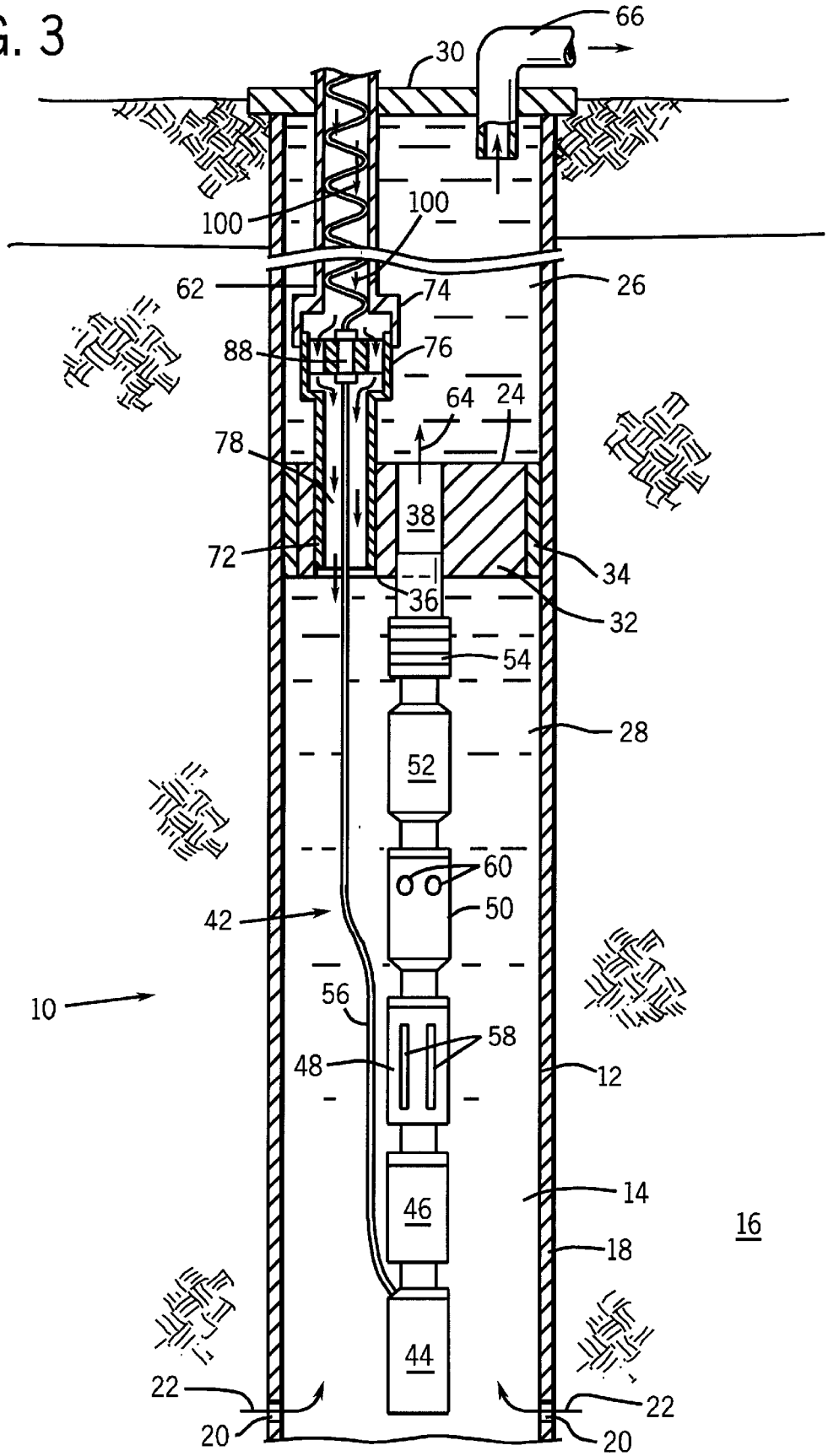
FIG. 3 is a front elevational view of a well completion system positioned in a wellbore to inject a liquid through a conduit having a power cable disposed therein.

FIG. 3 illustrates the use of completion system 10 to inject chemicals into a desired region of the wellbore. The embodiment of FIG. 3 generally includes the components of the completion system of FIG. 1. However, instead of venting gas, chemicals 100 are injected downward through gas production conduit 62 into lower zone 28. A chemical injection pump (not shown) may be coupled to gas production conduit 62 to force various chemicals, such as rust inhibitors, viscosity control chemicals, and so forth, into the vicinity of pumping system 42.

It will be understood that the foregoing description is of preferred exemplary embodiments of this invention, and that the invention is not limited to the specific forms shown. For example, a variety of different configurations of flow-through connectors may be used to couple the interior of a conduit to a passageway in a fluid barrier and to pass a power cable from the surface to a downhole tool. These and other modifications may be made in the design and arrangement of the elements without departing from the scope of the invention as expressed in the appended claims. Also, it is the intention of the applicants not to involve 35 U.S.C. §112, paragraph 6 for limitations of any of the claims herein, except for those in which the claim expressly uses the words "means for" together with an associated function.

What is claimed is:

1. A system for producing fluid from a wellbore comprising:

a packer disposed within a wellbore casing, the packer defining a first and a second zone of the wellbore;

a submersible pumping system to displace liquid from the first zone of the wellbore via a first fluid flow path;

a tubing extending from a surface location and having a cable disposed therein for supplying power to the submersible pumping system; and a second fluid flow path extending from the first zone of the wellbore to the surface location, wherein the second fluid flow pat extends through the tubing to the surface location, wherein gas is directed from the first zone to the surface location through the second fluid flow path.

2. The system as recited in claim 1, wherein the second fluid flow path is defined within the tubing by the cable and an interior surface of the tubing.

3. The system as recited in claim 2, wherein the cable is supported within the tubing by friction generated between the cable and the interior surface of the tubing.

4. The system as recited in claim 1, wherein the submersible pumping system comprises a gas separator, the gas separator producing gas separated from wellbore liquid.

5. The system as recited in claim 1, wherein liquid is displaced by the submergible pumping system to a surface location.

6. A system for producing fluid from a wellbore comprising:

a packer disposed within a wellbore casing, the packer defining a first and a second zone of the wellbore;

a submersible pumping system to displace liquid from the first zone of the wellbore via a first fluid flow path;

a tubing extending from a surface location and having a cable disposed therein for supplying power to the submersible pumping system; and a second fluid flow path extending from the first zone of the wellbore to the surface location, wherein the second fluid flow path extends through the tubing to the surface location, wherein liquid is directed to the first zone Through the second fluid flow path.

7. The system as recited in claim 6, further comprising a flow-through connector for fluidicly coupling the portion of the second fluid flow path extending through the tubing to a passageway through the packer.

8. The system as recited in claim 7, further comprising a cable connector for securing the power cable disposed within the tubing to the flow-through connector.

9. The system as recited in claim 8, wherein the power cable comprises a first electrical connector and the cable connector comprises a second electrical connector, the first and second electrical connectors being configured for mating engagement.

10. The system as recited in claim 8, further comprising a second power cable electrically coupled to the submersible pumping system and the cable connector.

11. A system for producing fluid from a wellbore comprising:

a packer disposed within a wellbore casing, the packer defining a first and a second zone of the wellbore;

a submersible pumping system to displace liquid from the first zone of the wellbore via a first fluid flow path, wherein the first fluid flow path is defined by an annulus formed within the wellbore casing;

a tubing extending from a surface location and having a cable disposed therein for supplying power to the submersible pumping system; and a second fluid flow path extending from the first zone of the wellbore to the surface location, wherein the second fluid flow path extends through the tubing to the surface location.

12. A well completion system for raising fluids from a well, the system comprising:

a packer for dividing the well into an upper zone and a lower zone, the packer having a first and a second passageway extending between the upper and lower zones;

a pumping system disposed in the lower zone, the pumping system being operative to displace fluids from the lower zone through the first passageway via a first fluid path;

a fluid conduit extending from a surface location and having a power cable disposed therein far supplying power to the pumping system, wherein the fluid conduit comprises a coil tubing having an interior surface, the power cable having an outer surface; and a second fluid path extending trough the fluid conduit to the second passageway in the packer, wherein the second fluid path is defined by the interior surface of the coil tubing and the outer surface of the power cable.

13. The well completion system as recited in claim 12, further comprising a flow-through connector secured to the packer, the flow-through connector being operable to secure the fluid conduit to the packer and fluidicly coupling the second passageway to the hollow interior of the fluid conduit.

14. The well completion system as recited in claim 12, further comprising a cable connector for coupling the power cable disposed within the hollow interior of the fluid conduit to a second power cable electrically coupled to the pumping system.

15. The well completion system as recited in claim 14, wherein the power cable comprises a first electrical connector and the second power cable comprises a second electrical connector.

16. The well completion system as recited in claim 15, wherein the first and second electrical connectors are configured for mating engagement.

17. The well completion system of claim 14, wherein the cable connector is disposed within a flow-through connector.

18. The system as recited in claim 12, wherein fluid is displaced by the submergible pumping system to a surface location.

19. A well completion system for raising fluids from a well, the system comprising:

a packer for dividing the well into an upper zone and a lower zone, the packer having a first and a second passageway extending between the upper and lower zones;

a pumping system disposed in the lower zone, the pumping system being operative to displace fluids from the lower zone through the first passageway via a first fluid path;

a fluid conduit extending from a surface location and having a power cable disposed therein for supplying power to the pumping system; and a second fluid path extending trough the fluid conduit to the second passageway in the packer, wherein the second fluid path is defined by the interior surface of the coil tubing and the outer surface of the power cable.

20. The system as recited in claim 19, wherein the gas is directed to a surface location.

21. A well completion system for raising fluids from a well, the system comprising:

a packer for dividing the well into an upper zone and a lower zone, the packer having a first and a second passageway extending between the upper and lower zones;

a pumping system disposed in the lower zone, the pumping system being operative to displace fluids from the lower zone through the first passageway via a first fluid path, wherein the pumping system includes a liquid/gas separator;

a fluid conduit extending from a surface location and having a power cable disposed therein for supplying power to the pumping system; and a second fluid path extending through the fluid conduit to the second passageway in the packer, wherein gas separated by the liquid/gas separator is directed from the lower zone through the second fluid path and liquid from the liquid/gas separator is displaced by the pumping system through the first fluid path.

22. A well completion system for raising fluids from a well, the system comprising:

a packer for dividing the well into an upper zone and a lower zone, the packer having a first and a second passageway extending between the upper and lower zones;

a pumping system disposed in the lower zone, the pumping system being operative to displace fluids from the lower zone through the first passageway via a first fluid path, wherein the first fluid path is defined by an annulus formed within the wellbore;

a fluid conduit extending from a surface location and having a power cable disposed therein for supplying power to the pumping system; and a second fluid path extending through the fluid conduit to the second passageway in the packer.

23. A method for producing fluid from a wellbore, comprising:

deploying in a wellbore a fluid barrier with a first passageway therethrough and a second passageway therethrough;

coupling a tubing from a surface location to the first passageway;

routing a power cable through the tubing;

directing a fluid through the tubing to the surface location; and producing a liquid through the second passageway.

24. The method as recited in claim 23, wherein the fluid is gas.

25. The method as recited in claim 24, wherein the gas is vented from the wellbore.

26. The method as recited in claim 23, wherein the fluid is liquid.

27. The method as recited in claim 26, wherein the liquid is injected into the wellbore.

28. The method as recited in claim 23, further comprising placing an electric submersible pumping system beneath the fluid barrier and fluidicly coupling the electric submersible pumping system to the second passageway.

29. The method of claim 28, further comprising combining a liquid/gas separator with the electric submersible pumping system to separate substantially gaseous components from substantially liquid components of wellbore fluids and to displace the substantially gaseous components into a zone beneath the fluid barrier.

30. The method as recited in claim 23, further comprising securing the tubing and the power cable to a flow-through connector secured to the fluid barrier.

31. The method as recited in claim 30, wherein securing comprises coupling the power cable to a first electrical connector within the flow-through connector.

32. The method as recited in claim 31, further comprising coupling a second power cable from the electric submersible pumping system to the flow-through connector, wherein the first and second electrical connectors are electrically coupled.

* * * * *